US010010111B2

(12) United States Patent
Rostami

(10) Patent No.: US 10,010,111 B2
(45) Date of Patent: Jul. 3, 2018

(54) E-VAPING DEVICE

(71) Applicant: Altria Client Services LLC, Richmond, VA (US)

(72) Inventor: Ali A. Rostami, Glen Allen, VA (US)

(73) Assignee: ALTRIA CLIENT SERVICES LLC, Richmond, VA (US)

( * ) Notice: Subject to any disclaimer, the term of this patent is extended or adjusted under 35 U.S.C. 154(b) by 570 days.

(21) Appl. No.: 14/638,830

(22) Filed: Mar. 4, 2015

(65) Prior Publication Data

US 2016/0255876 A1 Sep. 8, 2016

(51) Int. Cl.
*A24F 47/00* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS

| | | | |
|---|---|---|---|
| 6,854,461 | B2 | 2/2005 | Nichols et al. |
| 7,832,410 | B2 | 11/2010 | Hon |
| 8,365,742 | B2 | 2/2013 | Hon |
| 8,707,965 | B2 | 4/2014 | Newton |
| 8,833,364 | B2 | 9/2014 | Buchberger |
| 2012/0199146 | A1 | 8/2012 | Marangos |
| 2013/0192615 | A1* | 8/2013 | Tucker ..... H01C 17/00 131/328 |
| 2013/0192619 | A1 | 8/2013 | Tucker et al. |
| 2013/0213418 | A1* | 8/2013 | Tucker ..... A24F 47/008 131/328 |
| 2013/0306065 | A1 | 11/2013 | Thorens et al. |
| 2014/0000638 | A1 | 1/2014 | Sebastian et al. |
| 2014/0069424 | A1 | 3/2014 | Poston et al. |
| 2014/0261408 | A1 | 9/2014 | DePiano et al. |
| 2014/0283855 | A1 | 9/2014 | Hawes et al. |
| 2016/0242467 | A1* | 8/2016 | Vaughn ..... A24F 47/008 |

FOREIGN PATENT DOCUMENTS

| | | | |
|---|---|---|---|
| CN | 203646511 | U | 6/2014 |
| WO | WO-2014012905 | A1 | 1/2014 |
| WO | WO-2014054035 | A1 | 4/2014 |

* cited by examiner

*Primary Examiner* — Paul S Hyun
(74) *Attorney, Agent, or Firm* — Harness, Dickey & Pierce, P.L.C.

(57) ABSTRACT

An e-vaping device includes a first cartomizer section including a housing body with an inner tube extending longitudinally within the housing. A tubular reservoir for storing an e-vaping liquid is positioned between the housing body and the inner tube, with a wick in fluid communication with the tubular reservoir. A heater is configured to vaporize the e-vaping liquid in the wick. The tubular reservoir is helically wound around the inner tube, and a vent hole is included in a distal end of the tubular reservoir. A cross-sectional diameter of the wick equals a cross-sectional diameter of the tubular reservoir.

15 Claims, 3 Drawing Sheets

E-VAPING DEVICE

BACKGROUND OF THE INVENTION

Field of the Invention

Example embodiments relate generally to an e-vaping device. The e-vaping device may include a tubular liquid supply reservoir.

Related Art

Conventionally, e-vaping devices utilize a liquid supply reservoir that contains a liquid material. The liquid material is drawn toward a heater via a wick, where the heater vaporizes the liquid material, and the vaporized liquid is entrained in an air flow that is discharged into an adult vaper's mouth for consumption. However, an appreciable amount of liquid material in the liquid supply reservoir is often unused and ultimately wasted, as the liquid material may remain trapped in the reservoir. In particular, as the liquid material is consumed, a vacuum pressure may develop in a distal end of the reservoir, which may impede the liquid material from traveling through the reservoir and being discharged to a heater for vaporization.

SUMMARY OF THE INVENTION

At least one example embodiment relates to a cartomizer.

In one example embodiment, the cartomizer includes a housing body; a hollow inner body extending longitudinally within the housing body; a tubular reservoir configured to store an e-vaping liquid, at least a portion of the tubular reservoir disposed between the housing body and the inner body, the tubular reservoir being wound around the inner body; a wick in fluid communication with the tubular reservoir; and a heater configured to vaporize e-vaping liquid in the wick.

In one embodiment, the tubular reservoir is helically wound around the inner body.

In one embodiment, the tubular reservoir is made from a flexible material that is collapsible such that a distal end of the tubular reservoir is configured to collapse as the e-vaping liquid is consumed.

In one embodiment, the distal end of the tubular reservoir defines a vent hole. In one embodiment, a cross-sectional diameter of the wick is about equal to a cross-sectional diameter of the tubular reservoir.

In one embodiment, a distal end of the tubular reservoir defines a vent hole.

In one embodiment, a cross-sectional diameter of the tubular reservoir is between about 1.0 mm and about 3.0 mm, and a diameter of the vent hole is between about 100 micrometers and about 300 micrometers.

In one embodiment, the tubular reservoir is made from a rigid material.

In one embodiment, a cross-sectional diameter of the wick is about equal to a cross-sectional diameter of the tubular reservoir.

In one embodiment, a cross-sectional diameter of the wick is about equal to a cross-sectional diameter of the tubular reservoir.

In another embodiment, a cartomizer includes a housing body; a hollow inner body extending longitudinally within the housing body; a tubular reservoir configured to store an e-vaping liquid, at least a portion of the tubular reservoir disposed between the housing body and the inner body, the tubular reservoir being made from a flexible material that is collapsible; a wick in fluid communication with the tubular reservoir; and a heater configured to vaporize e-vaping liquid in the wick.

In one embodiment, a distal end of the tubular reservoir defines a vent hole.

In one embodiment, a cross-sectional diameter of the tubular reservoir is between about 1.0 mm and about 3.0 mm, and a diameter of the vent hole is between about 100 micrometers and about 300 micrometers.

In one embodiment, a cross-sectional diameter of the wick is about equal to a cross-sectional diameter of the tubular reservoir. In another embodiment, a cartomizer includes a housing body; a hollow inner body extending longitudinally within the housing body; a tubular reservoir configured to store an e-vaping liquid, at least a portion of the tubular reservoir disposed between the housing body and the inner body, a distal end of the tubular reservoir defining a vent hole; a wick in fluid communication with the tubular reservoir; and a heater configured to vaporize e-vaping liquid in the wick.

In one embodiment, a cross-sectional diameter of the wick is about equal to a cross-sectional diameter of the tubular reservoir.

In one embodiment, a cross-sectional diameter of the tubular reservoir is between about 1.0 mm and about 3.0 mm, and a diameter of the vent hole is between about 100 micrometers and about 300 micrometers.

In another embodiment, a cartomizer includes a housing body; a hollow inner body extending longitudinally within the housing body; a tubular reservoir configured to store an e-vaping liquid, at least a portion of the tubular reservoir disposed between the housing body and the inner body; a wick in fluid communication with the tubular reservoir, a cross-sectional diameter of the wick being about equal to a cross-sectional diameter of the tubular reservoir; and a heater configured to vaporize e-vaping liquid in the wick.

In one embodiment, the tubular reservoir is made from a flexible material that is collapsible such that a distal end of the tubular reservoir is configured to collapse as the e-vaping liquid is consumed.

In one embodiment, the tubular reservoir is made from a rigid material, a distal end of the tubular reservoir defining a vent hole.

In one embodiment, a cross-sectional diameter of the tubular reservoir is between about 1.0 mm and about 3.0 mm, and a diameter of the vent hole is between about 100 micrometers and about 300 micrometers.

In another embodiment, an e-vaping device includes a cartomizer; and a power supply electrically connected to the cartomizer.

BRIEF DESCRIPTION OF THE DRAWINGS

The above and other features and advantages of example embodiments will become more apparent by describing in detail, example embodiments with reference to the attached drawings. The accompanying drawings are intended to depict example embodiments and should not be interpreted to limit the intended scope of the claims. The accompanying drawings are not to be considered as drawn to scale unless explicitly noted.

DETAILED DESCRIPTION

Figure 1:
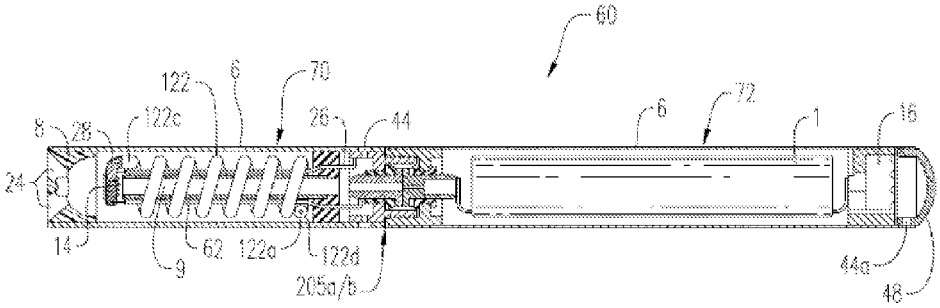
FIG. 1 is a detailed illustration of a cross-sectional view of an e-vaping device, in accordance with an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Figure 2:
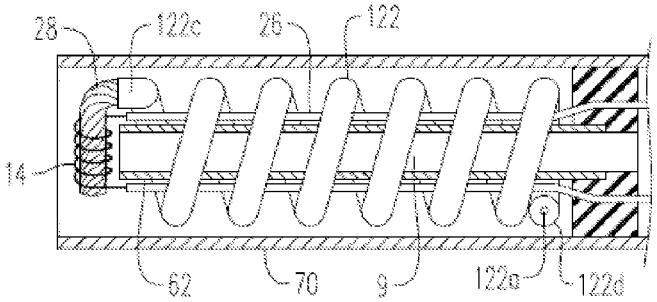
FIG. 2 is a magnified cross-sectional view of a section of an e-vaping device of FIG. 1, in accordance with an example embodiment.

FIG. 1 is a detailed illustration of a cross-sectional view of an e-vaping device 60, in accordance with an example embodiment. As shown in FIG. 1, the e-vaping device 60 may include a first major section (a cartridge, or "cartomizer") 70 and a second major section 72. The first and second sections 70/72 may each be encapsulated by an outer tube 6. Mating male/female threaded connections 205*a/b* may be used to join the two sections 70/72. A mouthpiece 8 with outlets 24 may be on an end of the first major section 70. The first major section 70 (shown in more detail in FIG. 2, showing a magnified view of section 70) may include a central air passage 9 defined by an inner tube 62. The inner tube 62 may be in fluid communication with outlets 24 of mouthpiece 8.

In operation, an adult vaper may use their mouth to draw air from the e-vaping device 60 via air outlets 24. Specifically, when an adult vaper inhales air from outlets 24, this inhalation causes air to be drawn into the e-vaping device 60*a* via air inlets 44/44*a*, and this air then travels through central air passage 9, and into the adult vaper's mouth via outlets 24. Puff sensor 16 senses this internal movement of air within the e-vaping device 60*a*, and causes power supply 1 to electrically energize heater 14 via electrical leads 26. Puff sensor 16 may also energize heater activation light 48 in order to indicate that the e-vaping device 60 is being operated. Wick 28 draws a liquid material (e-vaping liquid) from the liquid supply reservoir 22 towards heater 14 via a capillary action of wick 28. The heater 14 can be in the form of a wire coil, a planar body, a ceramic body, a single wire, a cage of resistive wire or any other suitable form. Liquid that is vaporized at heater 14 may become entrained in the air flowing through central air passage 9, such that the entrained vapor may enter the adult vaper's mouth via outlets 24.

A tubular liquid supply reservoir 122 may be used to contain the e-vaping liquid. This reservoir may be helically wound around inner tube 62. The tubular liquid supply reservoir 122 may have a circular cross-section, where a diameter of the reservoir 122 may be about equal to a diameter of the wick 28 that may be used to draw a e-vaping liquid from the liquid supply reservoir 122 to heater 14. In particular, an end of the wick 28 may be affixed within a proximal end 122*c* of the liquid supply reservoir 122, via crimping, friction fitting, adhesive, or other suitable means of affixing the wick 28 within the end 122*c* of reservoir 122. The liquid supply reservoir 122 may have a diameter that is small, in order to cause a e-vaping liquid to be driven through the reservoir 122 via a capillary force. In particular, the diameter of the liquid supply reservoir 122 may be between about 1.0 and 3.0 millimeters in diameter.

The wick 28 may be a porous medium, or a bundle of flexible filaments, that may combine to form uniformly sized interstitial spaces throughout the wick 28. As explained in more detail in conjunction with FIG. 3A/B, these interstitial spaces must be small, in order to ensure that a difference between a capillary force in wick 28 may overcome a capillary force in reservoir 122. This difference in capillary force, referred to herein as a "differential capillary force," may be great enough that the differential capillary force may exceed a weight of the e-vaping liquid in reservoir 122, allowing the wick 28 to draw e-vaping liquid toward heater 14 while e-vaping device 60 is in any orientation (including an orientation where wick 28 is drawing the liquid in a direction that is opposite to the direction of gravity).

In one embodiment, the filaments of the wick 28 may be generally aligned in a direction transverse to the longitudinal direction of the e-vaping device, but the example embodiments are not limited to this orientation. In one embodiment, the structure of the wick 28 is formed of ceramic filaments capable of drawing liquid via capillary action via interstitial spacing between the filaments to the heater 14. The wick 28 can include filaments having a cross-section which is generally cross-shaped, clover-shaped, Y-shaped or in any other suitable shape.

The wick 28 may include any suitable material or combination of materials. Examples of suitable materials are glass filaments and ceramic or graphite based materials. Moreover, the wick 28 may have any suitable capillarity accommodate aerosol generating liquids having different liquid physical properties such as density, viscosity, surface tension and vapor pressure. The capillary properties of the wick 28, combined with the properties of the liquid, ensure that the wick 28 is always wet in the area of the heater 14 to avoid overheating of the heater 14.

Instead of using a wick, the heater can be a porous material of sufficient capillarity and which incorporates a resistance heater formed of a material having a high electrical resistance capable of generating heat quickly.

The tubular liquid supply reservoir 122 may have a uniform diameter throughout the length of the reservoir 122. The tubular liquid supply reservoir 122 may be formed from a material that is thin and flexible, which may reduce production complexity of the e-vaping device 60*b* as the reservoir 122 may be easily wound around inner tube 62. For instance, tubular liquid supply reservoir 122 may be made from silicon, polypropylene, polyethylene, rubber, chemical resistant tubing, and/or any food and medical grade tubing. Due to the thin and flexible nature of the material that may be used to make the tubular liquid supply reservoir 122, the reservoir 122 may be collapsible. That is to say, as a capillary force effectively drives the e-vaping liquid through reservoir 122 and through wick 28 to heater 14, and as the e-vaping liquid is therefore vaporized and consumed, a distal end 122*d* of the reservoir 122 may collapse. Through this collapsing action, a potential vacuum force in the distal end 122*d* of reservoir 122 may be mitigated, such that the e-vaping liquid may travel through reservoir 122 without becoming trapped and/or impeded. By mitigating a potential vacuum force within reservoir 122, a higher degree of e-vaping liquid within reservoir 122 may be consumed by an adult vaper.

The tubular liquid supply reservoir 122 may alternatively be made from a rigid material. For instance, the tubular liquid supply reservoir 122 may be made from polyurethane, silicon, polypropylene, polyethylene, rubber, tygon, and/or any food and medical grade tubing. In the event that a rigid material is used, a vent hole 122*a* may be provided in the distal end 122*d* of reservoir 122, in order to allow air to enter the distal end 122*d* as the e-vaping liquid is consumed in order to mitigate a potential vacuum force within the reservoir 122. The vent hole 122*a* may have a smaller diameter than the diameter of the reservoir 122 (where the diameter of the vent hole 122*a* may be in the range of 100 to 300 micrometers), in order to allow air to enter the distal end 122*d* of the reservoir 122 as the e-vaping liquid is consumed, without allowing the e-vaping liquid to exit this vent hole 122*a*.

It should be understood that a vent hole 122*a* may also be included in a distal end 122*d* of a tubular liquid supply reservoir 122 made from the thin and flexible material (described above), in order to further assist in the mitigation of a potential vacuum force that may otherwise form in the reservoir 122 as the e-vaping liquid is consumed.

The e-vaping liquid may be any e-vaping liquid that is capable of being vaporized by heater 14. For instance, the e-vaping liquid may include a tobacco-containing material including volatile tobacco flavor compounds which are released from the liquid upon heating. The liquid may also be a tobacco flavor containing material or a nicotine-containing material. Alternatively, or in addition, the liquid may include a non-tobacco material(s). For example, the liquid may include water, solvents, active ingredients, ethanol, plant extracts and natural or artificial flavors. The liquid may further include an aerosol former. Examples of suitable aerosol formers are glycerine, propylene glycol, etc. Because of the diversity of suitable e-vaping liquids, it should be understood that these various liquids may include varying physical properties, such as varying densities, viscosities, surface tensions and vapor pressures.

The heater 14 may be a wire coil surrounding wick 28. Examples of suitable electrically resistive materials include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel. For example, the heater may be formed of nickel aluminides, a material with a layer of alumina on the surface, iron aluminides and other composite materials, the electrically resistive material may optionally be embedded in, encapsulated or coated with an insulating material or vice-versa, depending on the kinetics of energy transfer and the external physicochemical properties required. In one embodiment, the heater 14 comprises at least one material selected from the group consisting of stainless steel, copper, copper alloys, nickel-chromium alloys, superalloys and combinations thereof. In an embodiment, the heater 14 is formed of nickel-chromium alloys or iron-chromium alloys. In one embodiment, the heater 14 can be a ceramic heater having an electrically resistive layer on an outside surface thereof.

In another embodiment, the heater 14 may be constructed of an iron-aluminide (e.g., FeAl or Fe.sub.3Al), or nickel aluminides (e.g., Ni.sub.3Al). Use of iron-aluminides is particularly advantageous in that they exhibit high resistivity. FeAl exhibits a resistivity of approximately 180 micro-ohms, whereas stainless steel exhibits approximately 50 to 91 micro-ohms. The higher resistivity lowers current draw or load on the power source (battery) 1.

In one embodiment, the heater 14 comprises a wire coil which at least partially surrounds the wick 28. In that embodiment, the wire may be a metal wire and/or the heater coil that extends partially along the length of the wick 28. The heater coil may extend fully or partially around the circumference of the wick 28. In another embodiment, the heater coil is not in contact with the wick 28.

The heater 14 heats liquid in the wick 28 by thermal conduction. Alternatively, heat from the heater 14 may be conducted to the liquid by means of a heat conductive element or the heater 14 may transfer heat to the incoming ambient air that is drawn through the e-vaping device 60 during use, which in turn heats the liquid by convection.

The power supply 1 may be a Lithium-ion battery or one of its variants, for example a Lithium-ion polymer battery. Alternatively, the battery may be a Nickel-metal hydride battery, a Nickel cadmium battery, a Lithium-manganese battery, a Lithium-cobalt battery or a fuel cell. In that case, the e-vaping device 60 is usable until the energy in the power supply is depleted. Alternatively, the power supply 1 may be rechargeable and include circuitry allowing the battery to be chargeable by an external charging device. In that case, the circuitry, when charged, provides power for a desired (or alternatively a pre-determined) number of puffs, after which the circuitry must be re-connected to an external charging device.

The e-vaping device 60 also may include control circuitry including the puff sensor 16. The puff sensor 16 may be operable to sense an air pressure drop and initiate application of voltage from the power supply 1 to the heater 14. Alternatively, the control circuitry may include a manually operable switch for an adult vaper to initiate a puff. The time-period of the electric current supply to the heater may be pre-set depending on the amount of liquid desired to be vaporized. The control circuitry may be programmable for this purpose. Alternatively, the circuitry may supply power to the heater as long as the puff sensor detects a pressure drop.

When activated, the heater 14 may heat a portion of the wick 28 surrounded by the heater for less than about 10 seconds, more preferably less than about 7 seconds. Thus, the power cycle (or maximum puff length) can range in period from about 2 seconds to about 10 seconds (e.g., about 3 seconds to about 9 seconds, about 4 seconds to about 8 seconds or about 5 seconds to about 7 seconds).

The mouthpiece 8 may be integrally affixed within the tube 6 of the cartridge 70. Moreover, the mouthpiece 8 may be formed of a polymer selected from the group consisting of low density polyethylene, high density polyethylene, polypropylene, polyvinylchloride, polyetheretherketone (PEEK) and combinations thereof. The mouthpiece 8 may also be colored if desired.

In an embodiment, the e-vaping device 60 may be about the same size as a conventional cigarette. In some embodiments, the e-vaping device 60 can be about 80 mm to about 110 mm long, preferably about 80 mm to about 100 mm long and about 7 mm to about 8 mm in diameter. For example, in an embodiment, the e-vaping device may be about 84 mm long and have a diameter of about 7.8 mm.

In one embodiment, the e-vaping device 60 may also include a filter segment upstream of the heater 14 and operable to restrict flow of air through the e-vaping device 60. The addition of a filter segment can aid in adjusting the resistance to draw.

The outer tube 6 and/or the inner tube 62 may be formed of any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK), ceramic, and polyethylene. In one embodiment, the material is light and non-brittle.

Figure 3A:
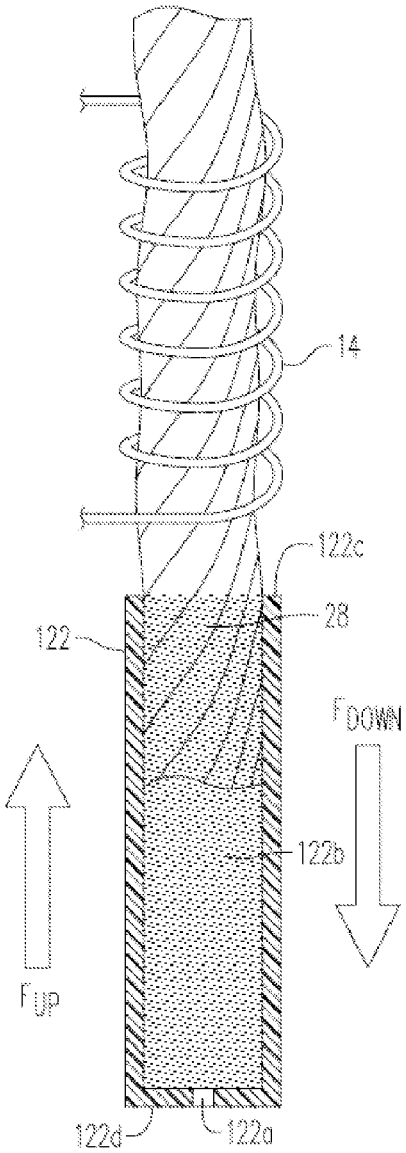
FIG. 3A is a simplified illustration of forces acting on liquid in a liquid supply reservoir, in accordance with an example embodiment.

FIG. 3A is a simplified illustration of forces acting on liquid in the liquid supply reservoir 122, in accordance with an example embodiment. In particular, FIG. 3A shows the reservoir 122 full of a e-vaping liquid 122*b*, where a downward capillary force (including a gravitational force, denoted as $F_{down}$) and an upward capillary force (denoted as $F_{up}$) is acting on the liquid 122*b*. It should be understood that the orientation shown in FIG. 3A constitutes a challenging condition for liquid flow to heater 14, because gravity is acting in a direction that is directly opposite to the desired direction of travel of the liquid 122*b* that is being drawn toward heater 14. As shown in Equation 1, upward force $F_{up}$ may be quantified.

$$F_{up}=n(2\pi r\sigma)\cos(\theta_v) \qquad \text{Equation 1}$$

where n may be a number of parallel upward interstitial channels within wick 28, r may be an equivalent radius of the porous structure of the wick 28, σ may be a surface tension of the liquid 122*b*, and $\theta_v$ may be a contact angle between the liquid 122*b* and the solid material used to form the wick 28.

Based on this understanding, the downward capillary force $F_{down}$ may be quantified, as shown in Equation 2.

$$F_{down}=(2\pi R\sigma)\cos(\theta_R) \qquad \text{Equation 2}$$

where R may be the reservoir tube 122*b* diameter. A number of interstitial flow channels in wick 28 may therefore depend on a relative size of R and r, which is proportional to $(R/r)^2$.

Because R (which may be about 1.0 to 3.0 millimeters) is significantly larger than r (which may be about 5-15 microns), n is expected to be a relatively large number. This differential capillary force may therefore force the liquid 122*b* upward and through wick 28 to heater 14, even in the orientation where gravity is acting to pull the liquid 122*b* in a direction that is opposite to the desired direction of travel of the liquid toward the heater 14, and even for e-vaping liquids with a wide range of viscosities and surface tensions.

Figure 3B:
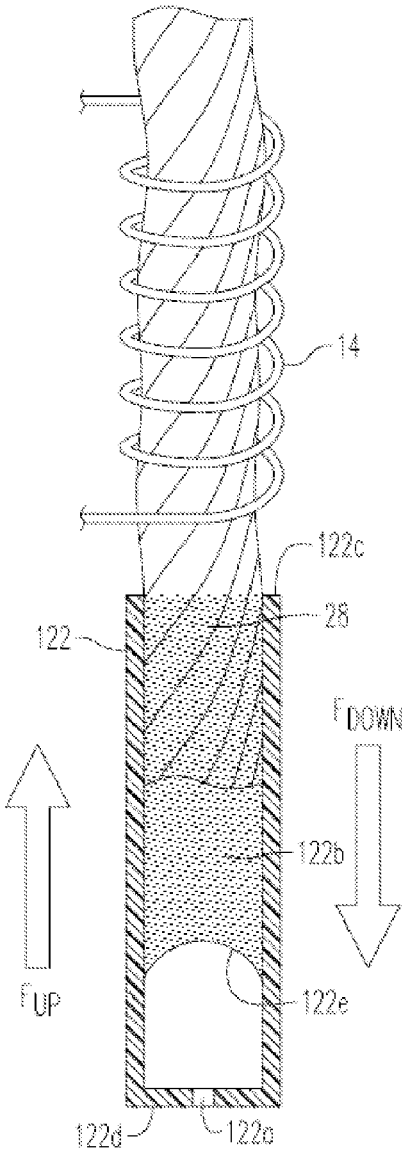
FIG. 3B is a simplified illustration of forces acting on liquid in a partially full liquid supply reservoir, in accordance with an example embodiment.

FIG. 3B is a simplified illustration of forces acting on liquid in a partially full liquid supply reservoir 122, in accordance with an example embodiment. In particular, FIG. 3B depicts vent hole 122*a* allowing air to enter reservoir 122 as the e-vaping liquid is being consumed and vaporized by heater 14. Due to the surface tension of the e-vaping liquid 122*b*, a curvature 122*e* of the liquid 122*b* may form near the distal end 122*d* of the reservoir 122. However, by properly designing the interstitial pores/channels of wick 28 to be small enough to ensure that the liquid 122*b* may be discharged from reservoir 122 through the wick 28 to heater 14 in all orientations of e-vaping device 60*b*, little to none of the liquid 122*b* will be left behind in the reservoir 122 as the liquid 122*b* is being consumed.

Figure 4:
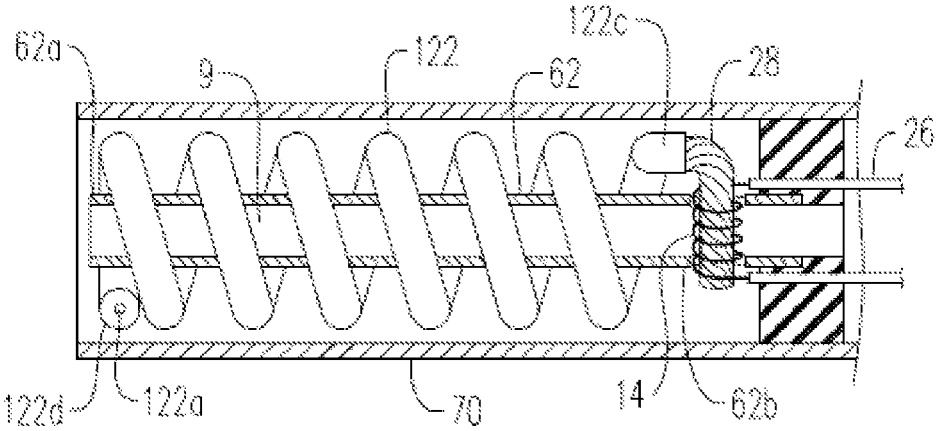
FIG. 4 is a magnified cross-sectional view of another section of an e-vaping device, in accordance with an example embodiment.

FIG. 4 is a magnified illustration of a cross-sectional view of another section 70 of an e-vaping device, in accordance with an example embodiment. The section 70*a* is identical to the section 70 shown in FIG. 2, with the following differences. The vaporizer (the collective term for heater 14 and wick 28) may be located on a distal end 62*b* of inner tube 62, rather than on a proximal end 62*a* of the inner tube 62, as shown in FIG. 2. By placing the vaporizer 14/28 on either the distal end 62*b* (as shown in FIG. 4) or proximal end 62*a* (as shown in FIG. 2) of inner tube 62, the annular space surrounding an outer periphery of inner tube 62 may be maximized, such that a greater amount of this annular space may be monopolized by the tubular liquid supply reservoir 122.

While the example embodiments described above disclose a cartomizer 70 with a liquid supply reservoir 122 that is a part of a two-piece e-vaping device 60 configuration (where cartomizer 70 and power-supply section 72 form the two major pieces of the device 60), it should be understood that the liquid supply reservoir 122 may alternatively be included in a one-piece e-vaping device. That is to say, the components of the cartomizer 70 may optionally not be removably attachable to a power supply section or an e-vaping device. Alternatively, the liquid supply reservoir 122 may also be included in other e-vaping device configurations, where the components of the e-vaping device may be separated into multiple sections (of three, or four, or more sections) of an overall e-vaping device.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

What is claimed is:

1. A cartomizer, comprising:
- a housing body;
- a hollow inner body extending longitudinally within the housing body;
- a tubular reservoir configured to store an e-vaping liquid, at least a portion of the tubular reservoir disposed between the housing body and the inner body, the tubular reservoir being wound around the inner body;
- a wick in fluid communication with the tubular reservoir; and
- a heater configured to vaporize e-vaping liquid in the wick.

2. The cartomizer of claim 1, wherein the tubular reservoir is helically wound around the inner body.

3. The cartomizer of claim 2, wherein the tubular reservoir is made from a flexible material that is collapsible such that a distal end of the tubular reservoir is configured to collapse as the e-vaping liquid is consumed.

4. The cartomizer of claim 3, wherein the distal end of the tubular reservoir defines a vent hole.

5. The cartomizer of claim 4, wherein a cross-sectional diameter of the wick is about equal to a cross-sectional diameter of the tubular reservoir.

6. The cartomizer of claim 1, wherein a distal end of the tubular reservoir defines a vent hole.

7. The cartomizer of claim 6, wherein a cross-sectional diameter of the tubular reservoir is between about 1.0 mm and about 3.0 mm, and a diameter of the vent hole is between about 100 micrometers and about 300 micrometers.

8. The cartomizer of claim 6, wherein the tubular reservoir is made from a rigid material.

9. The cartomizer of claim 6, wherein a cross-sectional diameter of the wick is about equal to a cross-sectional diameter of the tubular reservoir.

10. The cartomizer of claim 1, wherein a cross-sectional diameter of the wick is about equal to a cross-sectional diameter of the tubular reservoir.

11. An e-vaping device, comprising:
- the cartomizer of claim 1; and
- a power supply electrically connected to the cartomizer.

12. A cartomizer, comprising:
- a housing body;
- a hollow inner body extending longitudinally within the housing body;
- a tubular reservoir configured to store an e-vaping liquid, at least a portion of the tubular reservoir disposed between the housing body and the inner body, a distal end of the tubular reservoir defining a vent hole;
- a wick in fluid communication with the tubular reservoir; and
- a heater configured to vaporize e-vaping liquid in the wick, wherein a cross-sectional diameter of the wick is about equal to a cross-sectional diameter of the tubular reservoir.

13. The cartomizer of claim 12, wherein a cross-sectional diameter of the tubular reservoir is between about 1.0 mm and about 3.0 mm, and a diameter of the vent hole is between about 100 micrometers and about 300 micrometers.

14. A cartomizer, comprising:
- a housing body;
- a hollow inner body extending longitudinally within the housing body;
- a tubular reservoir configured to store an e-vaping liquid, at least a portion of the tubular reservoir disposed between the housing body and the inner body;
- a wick in fluid communication with the tubular reservoir, a cross-sectional diameter of the wick being about equal to a cross-sectional diameter of the tubular reservoir; and
- a heater configured to vaporize e-vaping liquid in the wick, wherein the tubular reservoir is made from a rigid material, a distal end of the tubular reservoir defining a vent hole.

15. The cartomizer of claim 14, wherein a cross-sectional diameter of the tubular reservoir is between about 1.0 mm and about 3.0 mm, and a diameter of the vent hole is between about 100 micrometers and about 300 micrometers.

* * * * *